US008061312B2

(12) United States Patent
Oh

(10) Patent No.: US 8,061,312 B2
(45) Date of Patent: Nov. 22, 2011

(54) CONTINUOUS VARIABLE VALVE LIFT APPARATUS

(75) Inventor: Chung Han Oh, Yongin (KR)

(73) Assignee: Hyundai Motor Company, Seoul (KR)

( * ) Notice: Subject to any disclaimer, the term of this patent is extended or adjusted under 35 U.S.C. 154(b) by 634 days.

(21) Appl. No.: 12/184,027

(22) Filed: Jul. 31, 2008

(65) Prior Publication Data

US 2009/0151675 A1 Jun. 18, 2009

(30) Foreign Application Priority Data

Dec. 14, 2007 (KR) ..... 10-2007-0131568

(51) Int. Cl.
*F01L 1/34* (2006.01)

(52) U.S. Cl. ..... 123/90.16; 123/90.39; 74/559

(58) Field of Classification Search ..... 123/90.16, 123/90.39, 90.2; 74/559, 567, 569
See application file for complete search history.

(56) References Cited

U.S. PATENT DOCUMENTS 6,907,852 B2 6/2005 Schleusener et al.

FOREIGN PATENT DOCUMENTS

JP 2007-170333 A 7/2007

*Primary Examiner* — Ching Chang
(74) *Attorney, Agent, or Firm* — Morgan, Lewis & Bockius LLP

(57) ABSTRACT

A lift of a valve of an engine may continuously be varied by an apparatus that includes: an input cam provided on an input shaft; a pivot shaft provided in parallel with the input shaft; a lever that rotates around the pivot shaft by a rotation of the input cam and operates the valve; and a lift varying device capable of varying a relative distance between the pivot shaft and the input shaft.

18 Claims, 4 Drawing Sheets

CONTINUOUS VARIABLE VALVE LIFT APPARATUS

CROSS-REFERENCE TO RELATED APPLICATION

This application claims priority to and the benefit of Korean Patent Application No. 10-2007-0131568 filed in the Korean Intellectual Property Office on Dec. 14, 2007, the entire contents of which are incorporated herein by reference.

BACKGROUND OF THE INVENTION (a) Field of the Invention

The present invention relates to an engine. More particularly, the present invention relates to a continuously variable valve lift apparatus of an engine.

(b) Description of the Related Art

An internal combustion engine generates power by burning fuel in a combustion chamber in air media drawn into the chamber. Intake valves of a valve system are operated by a camshaft in order to intake the air, and the air is drawn into the combustion chamber while the intake valves are open. In addition, exhaust valves of the valve system are operated by a camshaft, and a combustion gas is exhausted from the combustion chamber while the exhaust valves are open.

An optimal operation of the intake valves and the exhaust valves depends on a rotation speed of the engine, and optimal opening/closing timing of the valves or an optimal lift depends on the rotation speed of the engine. In order to achieve such an optimal valve operation depending on the rotation speed of the engine, research has been undertaken on a continuously variable valve lift ("CVVL") apparatus that is capable of continuously varying the valve lift depending on the engine speed.

The above information disclosed in this Background section is only for enhancement of understanding of the background of the invention and therefore it may contain information that does not form the prior art that is already known in this country to a person of ordinary skill in the art.

SUMMARY OF THE INVENTION

The present invention has been made in an effort to provide a continuously variable valve lift apparatus having advantages of a simple structure and easy application.

An exemplary embodiment of the present invention provides an apparatus for continuously varying a lift of a valve that includes: an input cam provided on an input shaft; a pivot shaft provided substantially in parallel with the input shaft; a lever that rotates around the pivot shaft by a rotation of the input cam and operates the valve; and a lift varying device capable of varying a relative distance between the pivot shaft and the input shaft.

The live varying device may include: a link connected with the pivot shaft; and an eccentric shaft connected with the link.

The lift varying device may further include: an eccentric shaft gear for rotating the eccentric shaft; and an eccentric shaft drive motor for driving the eccentric shaft gear.

The eccentric shaft may be eccentrically connected with an eccentric shaft journal that is supported by a journal support.

The lever may include an input roller provided at a location where the lever contacts the input cam.

The exemplary apparatus may further include a return spring for maintaining a contact between the input cam and the input roller.

BRIEF DESCRIPTION OF THE DRAWINGS

The above and other features of the present invention will now be described in detail with reference to certain exemplary embodiments thereof illustrated the accompanying drawings which are given hereinbelow by way of illustration only, and thus are not limitative of the present invention, and wherein.

Figure 1:
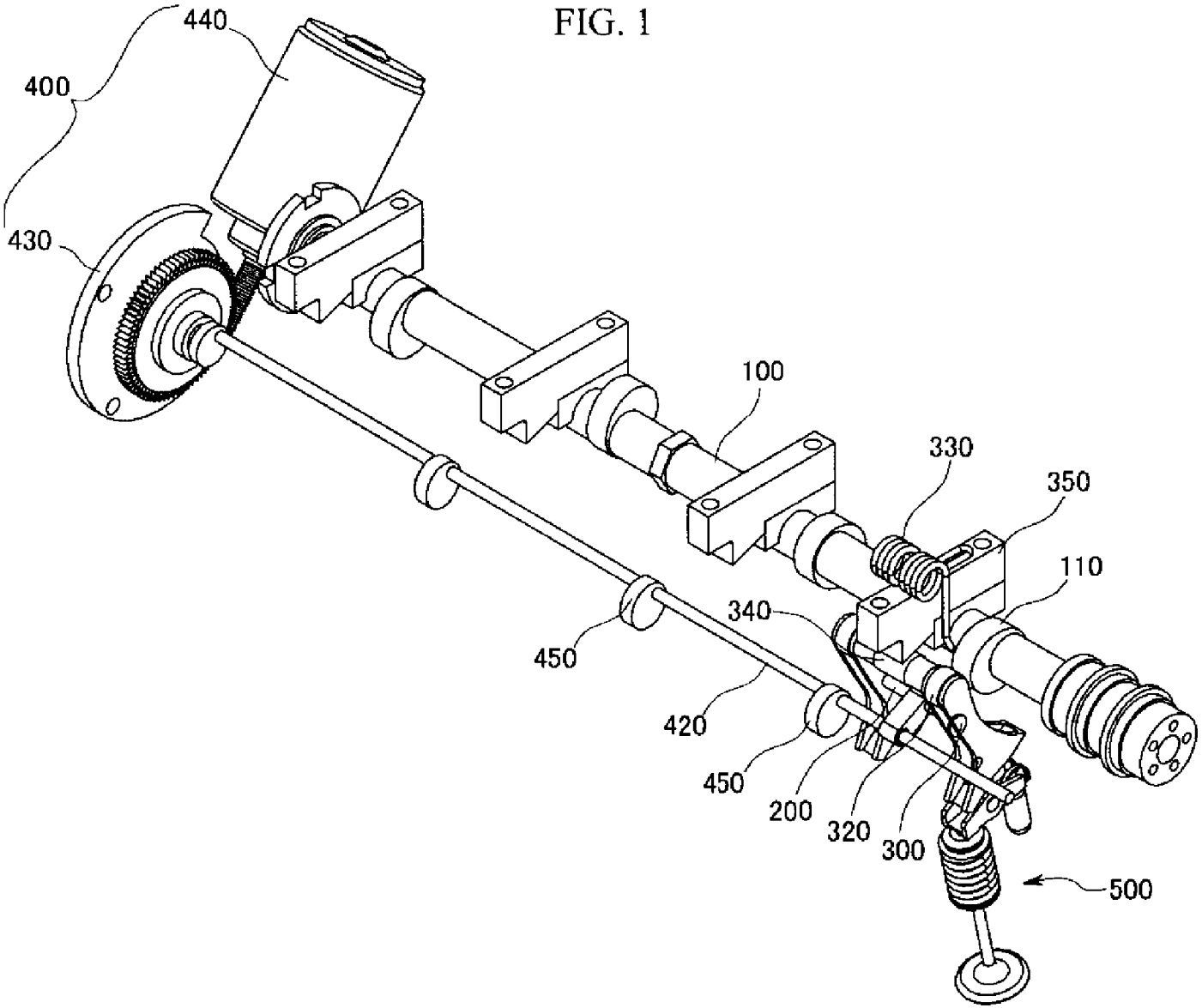
FIG. 1 is a perspective view of a continuously variable valve lift apparatus according to an exemplary embodiment of the present invention.

In the figures, reference numbers refer to the same or equivalent parts of the present invention throughout the several figures of the drawing.

| <Representative Reference Numerals> | |
|---|---|
| 100: input shaft | 110: input cam |
| 200: pivot shaft | 300: lever |
| 310: valve driving arm | 320: input roller |
| 330: return spring | 400: lift varying device |
| 410: link | 420: eccentric shaft |
| 430: eccentric shaft gear | 440: eccentric shaft drive motor |
| 450: eccentric shaft journal | 460: journal support |
| 500: valve unit | |

DETAILED DESCRIPTION OF THE EMBODIMENTS

Hereinafter reference will now be made in detail to various embodiments of the present invention, examples of which are illustrated in the accompanying drawings and described below. While the invention will be described in conjunction with exemplary embodiments, it will be understood that present description is not intended to limit the invention to those exemplary embodiments. On the contrary, the invention is intended to cover not only the exemplary embodiments, but also various alternatives, modifications, equivalents and other embodiments, which may be included within the spirit and scope of the invention as defined by the appended claims.

Hereinafter, a CVVL apparatus according to an exemplary embodiment of the present invention is described in detail with reference to FIG. 1 to FIG. 4.

As shown in FIG. 1, a CVVL apparatus according to an exemplary embodiment of the present invention continuously varies a lift length of a valve unit 500

Referring back to FIG. 1, The CVVL apparatus of an exemplary embodiment includes an input cam 110 provided on an input shaft 100 and a pivot shaft 200 provided substantially in parallel with the input shaft 100.

The CVVL apparatus further includes a lever 300 wherein the pivot shaft 200 is connected to a portion of the lever 300. The lever 300 pivotally rotates around the pivot shaft 200 with respect to a support shaft in response to a rotation of the input cam 110 and thus operates the valve unit 500 that may include a valve 510, a valve spring 520, a swing arm 530, and a lash adjuster 540, as shown in FIG. 3

Figure 2:
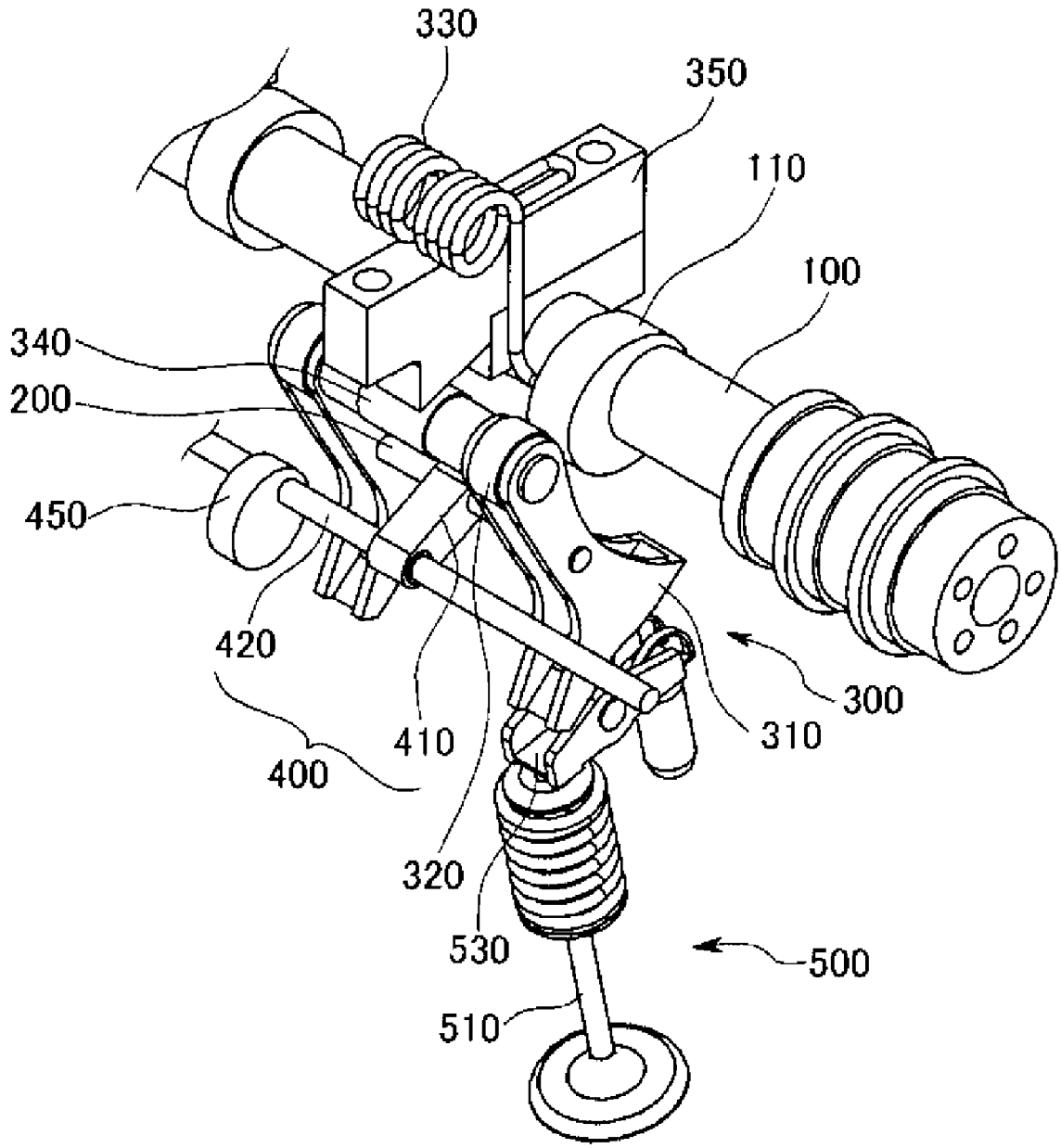
FIG. 2 is an enlarged perspective view of FIG. 1 showing configuration of a CVVL apparatus according to an exemplary embodiment of the present invention with respect to a single valve unit.
Figure 3:
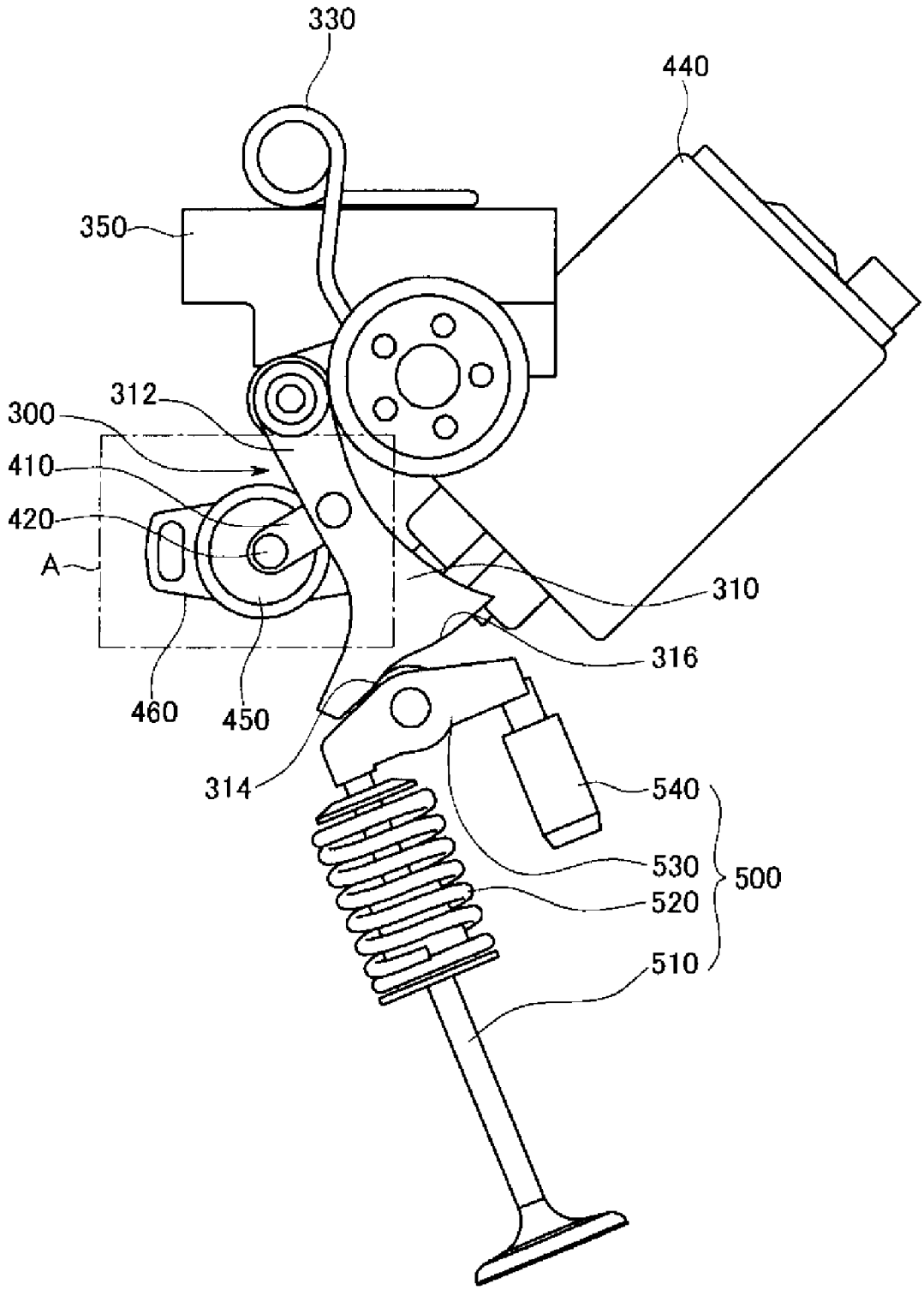
FIG. 3 is a lateral view of a CVVL apparatus according to an exemplary embodiment of the present invention.

The lever 300 includes a valve driving arm 310 that operates the valve unit 500 (in more detail, the valve 510 through the swing arm 530) as the lever 300 pivotally rotates, as shown in FIG. 2 and FIG. 3 as explained later in detail.

The CVVL apparatus further includes a lift varying device 400 that is capable of varying a relative distance between the pivot shaft 200 and the input shaft 100.

As shown in FIG. 2, the lift varying device 400 includes a link 410 pivotally coupled to the pivot shaft 200 and an eccentric shaft 420.

As shown in FIG. 1, the lift varying device 400 further includes an eccentric shaft gear 430 and an eccentric shaft drive motor 440. The eccentric shaft gear 430 is driven by the eccentric shaft drive motor 440 and thereby rotates the eccentric shaft 420.

An eccentric shaft journal 450 is coaxially connected with the eccentric shaft gear 430 but the eccentric shaft 420 is offset with a predetermined distance from a rotation center of the eccentric shaft journal 450, so that an angular position of the eccentric shaft 420 is varied by rotation of the eccentric shaft drive motor 440.

Although the eccentric shaft gear 430 and the eccentric shaft drive motor 440 are employed in the present embodiment, it may be understood that variations thereto may be employed. For example, the lift varying device 400 may include a hydraulic device that is capable of varying the angular position of the eccentric shaft 420.

Figure 4:
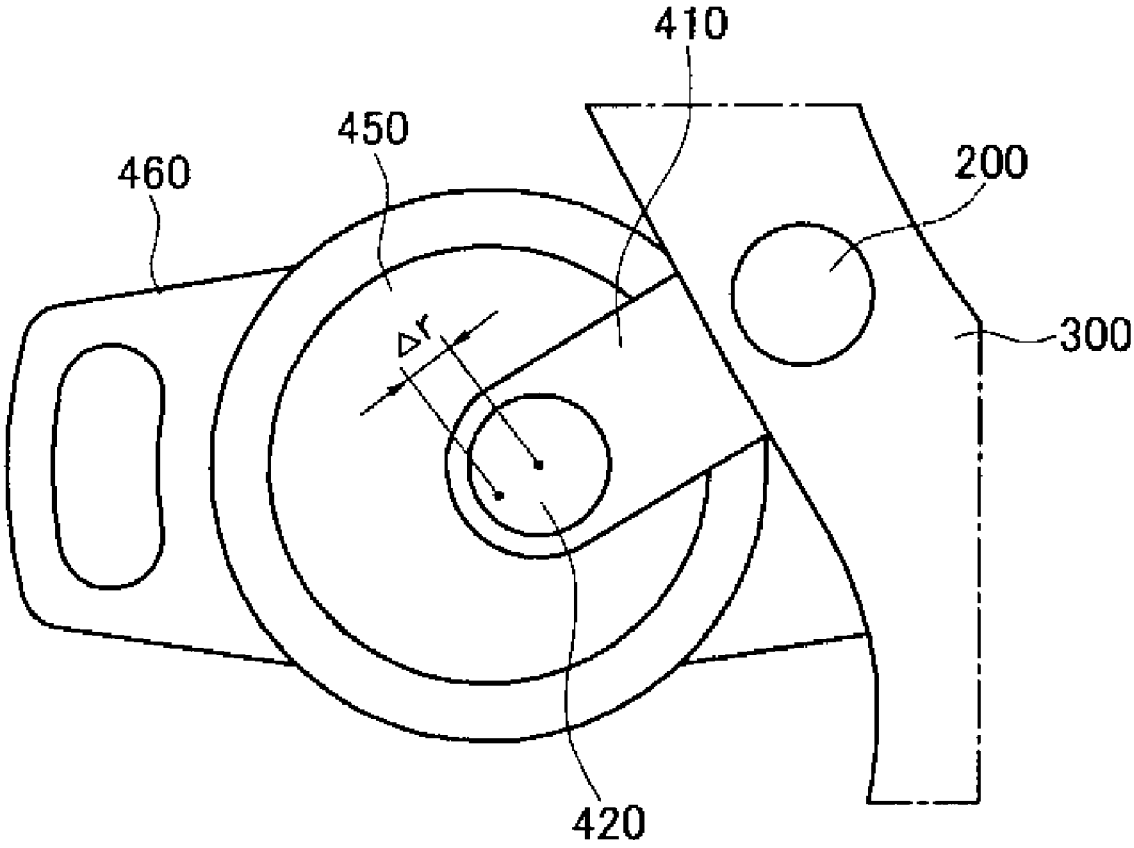
FIG. 4 is an enlarged view of a portion A of FIG. 3.

In detail, as shown in FIG. 3 and FIG. 4, the eccentric shaft 420 is eccentrically connected with an eccentric shaft journal 450 with a predetermined distance Δr and the eccentric shaft journal 450 is slidably supported by a journal support 460.

As shown in FIG. 2, the lever 300 comprises a valve driving arm 310 and an input arm 312. The valve driving arm 310 further may comprise a first profile portion 314 and a second profile portion 316 in an exemplary embodiment of the present invention. The valve driving arm 310, first profile portion 314 and second profile portion 316 may be shaped of "Y."

An input roller 320 is provided to a distal end portion of the input arm 312 of the lever 300 so that the lever 300 contacts the input cam 110 via the input roller 320.

The first profile portion 314 and second profile portion 316 is formed at lower portion of the valve driving arm 310. The first and second profile portions 314 and 316 determine lift length of the valve 510.

The variety of shapes of profiles may be employed at the first profile portion 314 and second profile portion 316 in accordance with embodiments.

A support shaft 340 is formed at the distal end portion of the input arm 312 of the lever 300.

A return spring 300 is employed so that a contact between the input cam 110 and the input roller 300 is maintained. In other words, a support block 350 is slidably provided on the input shaft 100 and one end of a return spring 300 is coupled to the support block 350 and the other end of the return spring 300 is coupled to a fixed body (e.g., a cylinder head) so as to bias the support block 350 downwards with respect to the input cam 110.

A lower portion of the support block 350 is slanted downward with a predetermined degree with respect to horizontal direction to receive the support shaft 340.

The predetermined degree of the support block 350 downwardly-biased by the return spring 330 makes a contact between the input cam 110 and the input roller 320 maintained effectively and thus prevents the support shaft 340 from leaving apart therefrom.

Hereinafter, an operation of the CVVL apparatus according to an exemplary embodiment of the present invention is described in detail.

When a lift length of the valve 510 is required to be varied, the eccentric shaft gear 430 is rotated by the eccentric shaft drive motor 440 so that the eccentric shaft journal 450 rotates. The eccentric shaft 420 revolves around a center of the eccentric shaft journal 450 in accordance with rotation of the eccentric shaft journal 450 since the eccentric shaft 420 is eccentric with respect to the eccentric shaft journal 450 by a predetermined amount Δr.

Thereby, a relative distance between the pivot shaft 200 and the eccentric shaft journal 450 is changed and consequently a relative distance between the pivot shaft 200 and the input shaft 100 is varied.

When the pivot shaft 200 becomes farther from the input shaft 100, the valve unit 500 is operated by the second profile portion 316 of the valve driving arm 310.

When the pivot shaft 200 becomes closer to the input shaft 100, the valve unit 500 is operated by the first profile portion 314 of the valve driving arm 310 as shown in FIG. 3.

Therefore, the lift of the valve 510 may be varied depending on an external profile of the valve driving arm 310.

It may be understood that a valve opening/closing timing may also be varied depending on by which portion of the valve driving arm 310 is operated.

While this invention has been described in connection with what is presently considered to be practical exemplary embodiments, it is to be understood that the invention is not limited to the disclosed embodiments, but, on the contrary, is intended to cover various modifications and equivalent arrangements included within the spirit and scope of the appended claims.

What is claimed is:

1. An apparatus for continuously varying a lift of a valve, comprising:

an input cam provided on an input shaft;

a support shaft positioned substantially in parallel with the input shaft;

a lever rotating on the support shaft, the lever having a surface cooperating with the input cam;

a pivot shaft extending from the lever;

a lift varying device cooperating with the pivot shaft, configured to vary valve lift in response to movement of the pivot shaft, based on rotation of the input cam;

wherein the lift varying device comprises:

a link, a first end of which is coupled to the pivot shaft; and an eccentric shaft coupled to a second end of the link.

2. The apparatus of claim 1, wherein the lift varying device further comprises:

an eccentric shaft gear rotating the eccentric shaft; and an eccentric shaft drive motor driving the eccentric shaft gear.

3. The apparatus of claim 2, wherein the eccentric shaft is eccentrically coupled with a rotation center of an eccentric shaft journal configured to be positioned coaxial to a rotation center of the eccentric shaft gear and the eccentric shaft journal is slidably supported by a journal support.

4. The apparatus of claim 3, wherein the lever comprises an input roller provided at a location where the lever contacts the input cam.

5. The apparatus of claim 4, wherein the support shaft is formed at the lever to be co-axially aligned to the input roller.

6. The apparatus of claim 4, wherein the lever further comprises at least a profile portion to control a lift length of the valve.

7. The apparatus of claim 4, further comprising a return spring for maintaining a contact between the input cam and the input roller.

8. The apparatus of claim 2, wherein the lever comprises an input roller provided at a location where the lever contacts the input cam.

9. The apparatus of claim 8, wherein the support shaft is formed at the lever to be co-axially aligned to the input roller.

10. The apparatus of claim 8, wherein the lever further comprises at least a profile portion to control a lift length of the valve.

11. The apparatus of claim 8, further comprising a return spring for maintaining a contact between the input cam and the input roller.

12. The apparatus of claim 1, wherein the lever comprises an input roller provided at a location where the lever contacts the input cam.

13. The apparatus of claim 12, wherein the support shaft is formed at the lever to be co-axially aligned to the input roller.

14. The apparatus of claim 12, wherein the lever further comprises at least a profile portion to control a lift length of the valve.

15. The apparatus of claim 12, further comprising a return spring for maintaining a contact between the input cam and the input roller.

16. The apparatus of claim 1, further comprising a support block slidably coupled to a portion of the input shaft for maintaining a contact between the input cam and the lever.

17. The apparatus of claim 16, wherein a return spring biases the support block downwardly.

18. An apparatus for continuously varying a lift of a valve, comprising:

an input cam provided on an input shaft;

a support shaft positioned substantially in parallel with the input shaft;

a lever rotating on the support shaft, the lever having a surface cooperating with the input cam;

a pivot shaft extending from the lever;

a lift varying device cooperating with the pivot shaft, configured to vary valve lift in response to movement of the pivot shaft, based on rotation of the input cam;

a support block slidably coupled to a portion of the input shaft for maintaining a contact between the input cam and the lever; and further comprising a guide portion formed to be downwardly-slanted at a lower portion of the support block with a predetermined angle with respect to a horizontal direction to receive the support shaft.

* * * * *